US005567358A

United States Patent [19]

Makuta et al.

[11] Patent Number: 5,567,358

[45] Date of Patent: Oct. 22, 1996

[54] THICK FILM RESISTOR COMPOSITION

[75] Inventors: Fujio Makuta; Hiroshi Fukaya; Katsuhiro Kawakubo, all of Tokyo, Japan

[73] Assignee: Sumitomo Metal Mining Company Limited, Tokyo, Japan

[21] Appl. No.: 520,507

[22] Filed: Aug. 28, 1995

Related U.S. Application Data

[63] Continuation of Ser. No. 200,570, Feb. 22, 1994, abandoned, which is a continuation of Ser. No. 9,241, Jan. 26, 1993, abandoned.

[51] Int. Cl.[6] ..... H01B 1/00; H01B 1/08

[52] U.S. Cl. ..... 252/518; 252/521; 420/427; 238/204; 238/224

[58] Field of Search ..... 252/518, 521; 420/427; 338/204, 224

[56] References Cited

U.S. PATENT DOCUMENTS 4,209,764 6/1980 Merz et al. ..... 252/512

4,312,770 1/1982 Yu et al. ..... 252/519

FOREIGN PATENT DOCUMENTS

| | | |
|---|---|---|
| 47-8579 | 5/1972 | Japan . |
| 48-82391 | 11/1973 | Japan . |
| 51-28353 | 8/1976 | Japan . |
| 51-122799 | 10/1976 | Japan . |
| 54-1917 | 1/1979 | Japan . |
| 55-39883 | 10/1980 | Japan . |
| 57-26401 | 6/1982 | Japan . |
| 62-81701 | 4/1987 | Japan . |
| 495714 | 12/1975 | U.S.S.R. . |

*Primary Examiner*—Paul Lieberman
*Assistant Examiner*—M. Kopec
*Attorney, Agent, or Firm*—Burns, Doane, Swecker & Mathis, L.L.P.

[57] ABSTRACT

The temperature coefficient of resistance (TCR) is made zero with reduced noise in a thick film resistor composition essentially consisting of $Pb_2Ru_2O_{6-7}$, organic vehicle and non-conductive glass by adding $Ta_2O_5$ up to five weight %.

2 Claims, No Drawings

THICK FILM RESISTOR COMPOSITION

This application is a continuation of application Ser. No. 08/200,570, now abandoned, filed Feb.22, 1994 which is a continuation of application Ser. No. 08/009,241, filed Jan. 26, 1993 now abandoned.

BACKGROUND OF THE INVENTION

1. Field of the Invention

The present invention relates to a thick film resistor composition used for electronic parts such as a highly integrated circuit, a chip, a volume, or a high voltage resistor, more specifically to the thick film resistor composition having improved temperature dependency of resistance value and reduced current-noise.

2. Description of the Related Art

A thick film resistor composition used for electronic parts is made in the form of paste, which is made by mixing fine conductive powder such as $RuO_2$ and non-conductive glass powder with organic vehicle. The paste is applied to a ceramic substrate by using, for example, screen printing, and is fired at a predetermined temperature to form a resistor coating on the ceramic substrate.

The temperature coefficient of resistance (which is referred to as TCR hereinafter) and current-noise (which is referred to as noise hereinafter) are important characteristics of the thick film resistor composition produced as set forth above.

Practically, the TCR is represented by the rates of change which are referred to as "cold or low temperature coefficient (CTCR)" and as "hot or high temperature coefficient (HTCR)." The CTCR is the rate of change of resistance values at low temperature (at −55° C.) generally expressed using values per 1° C. (ppm/°C.) on the basis of resistance value at 25° C. as shown in the following expression Eq.1, and the HTCR is the rate of change of resistance value at high temperature (at 125° C.) generally expressed using values per 1° C. (ppm/°C.) on the basis of resistance value at 25° C. as shown in the following expression Eq.2.

Preferably, the TCR value becomes 0 ppm/°C.

Eq. 1

$$CTCR = \frac{R_{-55} - R_{25}}{R_{25}(-55 - 25)} \times 10^6$$

Eq. 2

$$HTCR = \frac{R_{125} - R_{25}}{R_{25}(125 - 25)} \times 10^6$$

where $R_{-55}$ is a resistance value (Ω/□) at −55° C., $R_{25}$ is a resistance value (Ω/□) at 25° C. and $R_{125}$ is a resistance value (Ω/□) at 125° C.

On the other hand, the noise is the current-noise occurring in the thick film resistor, and is measured by a Quan Tech noise meter. Preferably, the noise becomes as small a value as possible.

In order to obtain the TCR value as close as possible to zero, the thick film resistor has been improved by adding various types of inorganic compounds thereto. Various inorganic compounds are disclosed in, for example, Japanese Patent Application Laid-Open No. 48-82391, Japanese Patent Publication No. 55-39883 and Japanese Patent Publication No. 54-1917, Japanese Patent Application Laid-Open No. 47-8579, and Japanese Patent Publication No. 57-26401. In these publications, negative TCR adjustors such as $Nb_2O_5$, $TiO_2$, $MnO_2$ or $Sb_2O_3$, and positive TCR adjustors such as CuO are employed as additives.

Further, it is necessary to reduce an addition rate of the fine conductive powder in order to obtain a thick film resistor composition having higher sheet resistivity (Ω/□).

However, this increases the noise. Therefore, as disclosed in Japanese Patent Application Laid-Open No. 48-82391 and Japanese Patent Application Laid-Open No. 47-8579, the sheet resistivity has been increased while maintaining a higher addition rate of the fine conductive powder in the mixture by adding $Nb_2O_5$, $Sb_2O_3$ or the like.

However, there has been a problem in that the above conventional method tends to provide negative TCR.

SUMMARY OF THE INVENTION

In order to overcome the problem as set forth above, it is an object of the present invention to provide a thick film resistor composition which can have a TCR value close to zero, and reduced noise.

In order to achieve the object of the present invention, a thick film resistor composition is provided consisting essentially of organic vehicle, conductive material, non-conductive glass, and $Ta_2O_5$ in an amount equal to or less than five weight % with respect to a weight of total amount of the conductive material and non-conductive material glass.

PREFERRED EMBODIMENTS OF THE INVENTION

In the present invention, $Ta_2O_5$ is included in a thick film resistor paste including the organic vehicle, the conductive material and the non-conductive glass, and the weight of the $Ta_2O_5$ is not more than five weight % with respect to the total amount of the conductive material and non-conductive material glass.

The weight of $Ta_2O_5$ used in the present invention must be equal to or less than five weight % with respect to the total weight of conductive material and non-conductive glass. If the weight of $Ta_2O_5$ exceeds five weight % to the total weight, it is impossible to obtain increased sheet resistance of the thick film resistor composition as the amount of $Ta_2O_5$ is increased. Further, noise is defectively increased.

In the present invention, the $Ta_2O_5$ has desirably a particle diameter which is equal to or less than 1 μm.

It is desirable to employ $Pb_2Ru^2O_{6-7}$, $Bi_2Ru_2O_{6-7}$, $RuO_2$ or the like as the conductive material, and the conductive material preferably has a particle diameter equal to or less than 0.2 μm.

It is preferable to employ PbO—$SiO_2$-$B_2O_3$-$Al_2O_3$ series as non-conductive glass, and the non-conductive glass has a particle diameter which is equal to or less than 10 μm, preferably equal to or less than 5 μm.

Further, conventional additives (TCR adjustors) such as $MnO_2$, $Nb_2O_5$, $Sb_2O_3$ or CuO may be used with the above materials.

The thick film resistor composition of the present invention can be obtained by using any of the conventional methods used for the prior-art thick film resistor composition.

In the thick film resistor composition of the present invention, the index of temperature dependency of resistance value, i.e., TCR, corresponds closely to zero, and very small noise occurs. Therefore, the thick film resistor composition is highly effective as a resistor.

EXAMPLES 1 TO 6

Six types of resistor pastes according to the present invention as shown in Table 1 were prepared by mixing the following materials and sufficiently mixing by using a three-roll mill. The materials include an organic vehicle made of ethyl cellulose and terpineol, $Pb_2Ru_2O_{6-7}$ which is pyrochlore-oxide having a particle diameter range of 500 to 1000Å, glass having a composition Of PbO (53 weight %)-$SiO_2$ (32 weight %)-$B_2O_3$ (10 weight %)-$Al_2O_3$ (5 weight %) and an average particle diameter range 2 to 3 μm, $Ta_2O_5$ having a particle diameter of not more than 1 μm, and optionally $Nb_2O_5$, $Sb_2O_3$, $MnO_2$, and CuO.

These resistor pastes were screen-stenciled or printed on 96% alumina substrates, and dried at 150° C. Thereafter, the resistor pastes were fired in a belt furnace, provided that peak heating was made for ten minutes at 850° C. and entire heating time was 30 minutes, Accordingly, the thick film resistors were obtained to have a size of 1 mm × 1 mm, and film thickness range of 10 to 14 μm. The results of evaluation of these resistor characteristics are shown in Table 1.

In Examples, the resistor pastes were prepared so that the resistors have substantially 100 kΩ sheet resistivity.

COMPARATIVE EXAMPLES 1 TO 5

Another five types of resistor pastes shown in Table 1 were prepared for comparative examples as in the above examples to obtain thick film resistors except that the composition of Comparative Example 1 to 4 have no constituent of $Ta_2O_5$, and the composition of Comparative Example 5 has $Ta_2O_5$ over 5.0 weight %. The results of evaluation of compositions and characteristics of these resistors are also shown in Table 1.

As obviously seen from Table 1, the thick film resistor compositions of the present invention has HTCR and CTCR respectively close to zero, and has very small noise.

TABLE 1

| | Example of the Invention | | | | | |
|---|---|---|---|---|---|---|
| | No. 1 | No. 2 | No. 3 | No. 4 | No. 5 | No. 6 |
| $Pb_2Ru_2O_{6-7}$ (wt %) | 21.9 | 38.0 | 38.0 | 35.2 | 40.0 | 19.2 |
| Non-conductive glass (wt %) | 78.1 | 62.0 | 62.0 | 64.8 | 60.0 | 80.8 |
| $Ta_2O_5$ (wt %) | 1.1 | 2.9 | 5.0 | 2.0 | 1.9 | 0.5 |
| $Nb_2O_5$ (wt %) | | | | 0.1 | | |
| $Sb_2O_3$ (wt %) | | | | | 0.1 | |
| $MnO_2$ (wt %) | | | | 0.1 | | |
| CuO (wt %) | | | | | 0.1 | |
| Sheet Resistance (kΩ/□) | 100 | 106 | 109 | 100 | 91 | 95 |
| HTCR (ppm/°C.) | +98 | +77 | +65 | +37 | +55 | +79 |
| CTCR (ppm/°C.) | +32 | −1 | −19 | −75 | −60 | +22 |
| Noise (dB) | −13 | −15 | −8 | −11 | −15 | −7 |

| | Comparative Examples | | | | |
|---|---|---|---|---|---|
| | No. 1 | No. 2 | No. 3 | No. 4 | No. 5 |
| $Pb_2Ru_2O_{6-7}$ (wt %) | 16.6 | 21.0 | 35.0 | 13.4 | 38.0 |
| Non-conductive glass (wt %) | 83.4 | 79.0 | 65.0 | 86.6 | 62.0 |
| $Ta_2O_5$ (wt %) | | | | | 5.5 |
| $Nb_2O_5$ (wt %) | 0.5 | 1.1 | | | |
| $Sb_2O_3$ (wt %) | | | 0.4 | | |
| $MnO_2$ (wt %) | | | | | |
| CuO (wt %) | | | | | |
| Sheet Resistance (kΩ/□) | 98 | 102 | 110 | 105 | 121 |
| HTCR (ppm/°C.) | +85 | −95 | −111 | +205 | +55 |
| CTCR (ppm/°C.) | +21 | −201 | −164 | +178 | −25 |
| Noise (dB) | −2 | −4 | −5 | +3 | −3 |

What is claimed is:

1. A thick film resistor composition consisting essentially of:

at least one conductive material selected from the group consisting of $RuO_2$, $Pb_2Ru_2O_{6-7}$, and $Bi_2Ru_2O_7$;

non-conductive glass comprising PbO and SiO;

$Ta_2O_5$, in a amount of up to 5 weight percent with respect to the total weight of conductive material and non-conductive glass; and an organic vehicle.

2. The thick film resistor composition of claim 1, wherein $Ta_2O_5$ is contained in the range of 0.5 to 5.0 weight %.

* * * * *